US008166786B2

(12) United States Patent
Speck

(10) Patent No.: US 8,166,786 B2
(45) Date of Patent: May 1, 2012

(54) WIRE-FORMING MACHINE

(75) Inventor: Norbert Speck, Reutlingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 971 days.

(21) Appl. No.: 12/167,793

(22) Filed: Jul. 3, 2008

(65) Prior Publication Data

US 2009/0007619 A1 Jan. 8, 2009

(30) Foreign Application Priority Data

Jul. 6, 2007 (DE) ..... 10 2007 031 514
Sep. 12, 2007 (EP) ..... 07017890

(51) Int. Cl.
*B21F 35/00* (2006.01)
*B21F 3/02* (2006.01)

(52) U.S. Cl. ..... 72/137; 72/145; 72/140

(58) Field of Classification Search ..... 72/135, 72/137, 138, 140–142, 144, 441, 442, 446, 72/402, 455, 456
See application file for complete search history.

(56) References Cited

U.S. PATENT DOCUMENTS

| | | | |
|---|---|---|---|
| 4,920,776 | A | 5/1990 | Denzler |
| 6,101,860 | A | 8/2000 | Wu |
| 6,142,002 | A | 11/2000 | Itaya |
| 6,701,765 | B2 | 3/2004 | Itaya |
| 7,143,620 | B2 | 12/2006 | Itaya |

FOREIGN PATENT DOCUMENTS

| | | | |
|---|---|---|---|
| DE | 299 13 014 | U1 | 11/1999 |
| DE | 199 38 905 | B4 | 3/2000 |
| DE | 101 34 828 | B4 | 9/2002 |
| DE | 697 15 953 | T2 | 8/2003 |
| DE | 103 42 451 | A1 | 4/2004 |
| EP | 0 804 978 | B1 | 10/2002 |
| EP | 1 637 251 | A1 | 3/2006 |
| JP | 2007-030038 | | 2/2007 |
| JP | 2007-245240 | | 9/2007 |

*Primary Examiner* — Debra Sullivan
(74) *Attorney, Agent, or Firm* — Patterson Thuente Christensen Pedersen, P.A.

(57) ABSTRACT

A wire-forming machine, comprising a machine frame, a wire feeder and a wire guide for transporting wire to a working area of the machine where the wire is processed by one or more tools. The tools are affixed on a tool plate on the machine frame and around a recess formed in the plate. A wire is fed through the recess to the working area of the machine. The tool plate is fitted on a second plate and is displaceable along a first direction (x) relative to the second plate, while the second plate is displaceable along a second direction (y) relative to the machine plate. Both directions (x, y) have an inclination of 45° each to the vertical normal axis of the wire-forming machine and are perpendicular to each other.

18 Claims, 4 Drawing Sheets

WIRE-FORMING MACHINE

PRIORITY

The current application claims the benefit of priority to German Patent Application No. 10 2007 031 514.9, filed Jul. 6, 2007, and European Patent Application No. 07 017 890.0, filed on Sep. 12, 2007. Said applications are incorporated in their entirety by reference herein.

FIELD OF THE INVENTION

The invention is directed to a wire-forming machine, in particular a spring-bending or spring-winding machine, comprising a machine frame, a wire feeder, a wire guide for transporting the fed wire to a working area of the machine, in which the wire is processed and/or shaped by one or more tools.

BACKGROUND OF THE INVENTION

DE 101 34 828 B4 discloses a wire-forming machine in the form of a leg spring machine, wherein a multiplicity of tools are arranged on one plate. Each tool has a base plate and is provided with its own drive assigned only to the particular tool and whose actuation allows the tool to be moved radially towards the wire or away from it. The base plates can be coupled to a ring which can be swiveled around the wire's axis and via which a fine adjustment of the tools relative to the wire can be achieved during the manufacturing process (swing axle). However, in this disclosed machine, each tool is provided with its own drive, which makes the machine complex and expensive.

DE 103 42 451 A describes a leg spring machine, wherein the tool units are arranged on a round vertical table and can be mounted to the round vertical table in any angular position. A central driving wheel which drives camshaft blocks, wherein the camshaft blocks can be connected to the tool units in the sense of a cam drive, is provided for driving the movement of the tool units. Although, in this case, not every tool unit requires its own, exclusively assigned drive, the time sequence of the movements is not sufficiently freely programmable.

The wire-forming machine according to DE 199 38 905 B4 is again a leg spring machine, which comprises two turrets mounted next to the wire guide. The turrets are arranged on a 3D cross table and can thus be positioned anywhere in space. In addition, the turret can also be rotated about an axis parallel to the wire axis, so that different tools can be made to engage the wire at different positions. In this disclosed machine, however, the changing of tools is very slow and limits the performance of the machine considerably. Moreover, the machine disclosed in DE 199 38 905 B4 needs more room than conventional leg spring machines.

DE 299 13 014 U discloses a shaping unit in module form for wire-bending machines, the module of the unit consisting of a base plate with a drive, a linear guide and a slider crank. The shaping units can be simply mounted to a machine wall and dismounted from it again. However, there is a disadvantage in that each tool unit has its own drive assigned to it again, which in turn makes the machine expensive, in particular in case of large number of tools.

The leg spring machine of EP 1 637 251 A works with a feeding unit mounted either to a 2D or a 3D cross table. This allows the wire to be transported to the radially mounted tools; however, this requires movement of very large masses. Therefore, the performance and rigidity of the disclosed machine are reduced.

A further leg spring machine comprising a two-dimensionally movable feeder is disclosed in DE 697 15 953 T for optimal positioning of the wire relative to the tool. In this case, the tool head is arranged above the feeder and can be moved both horizontally and vertically. In addition, a rotary axis for the tool is also provided. However, the machine disclosed in DE 697 15 953 T allows only one tool to be mounted to the tool head. A separate tool unit is needed for cutting. The arrangement of the tool head is fixed in advance, namely, vertically from above.

A leg spring machine of the above-mentioned type is disclosed in JP-P2007-30038A. The tool table is linearly displaceable along a first direction on a second plate, which is in turn linearly displaceable along a second direction relative to the machine frame, the first direction extending horizontally and said second direction extending vertically with respect to the longitudinal axis of the machine. However, practical experience has shown that the machine disclosed in JP-P2007-30038A is subject to very strong vibrations during operation and considerable shaking of the entire machine occurs. The vibrations and shaking leads to highly undesirable vibrations at the respective, already produced, bent-wire parts, thus unfavorably influencing the entire coiling or winding process, respectively.

In view of the above, there is a need for a wire-forming machine which is simple in construction, low-vibrating during operation, and allows for achievement of high operative performance.

SUMMARY OF THE INVENTION

According to an embodiment of the invention, a wire-forming machine of the above-mentioned type is disclosed. In the embodiment, the two directions of displacement of the tool plate and of the second plate each extend at an inclination of approximately 45° to the vertical normal axis of the machine.

The wire-forming machine of the invention quite surprisingly leads to extremely low-vibration operation allowing achievement of particularly high manufacturing speeds and very good precision without occurrence of disturbing machine vibrations impairing the machine's output. Without being held to a particular theory, the manufacturing speeds and precision obtained, without disturbing vibrations, is probably due to the axes of displacement of both displaceable plates being oriented according to the invention. The lateral displacement amplitudes of either plate are usually smaller than in the case of a vertical-horizontal orientation of the two axes of displacement.

In one embodiment of the invention, the moving mass of the tool plate is relatively small, because it is only required to mount the tools needed in each case. Since any arrangement of the tools is possible, they can be mounted such that the tool plate's paths of displacement are reduced to a minimum.

In the wire-forming machine according to one embodiment of the invention, the longitudinal axes of all tools mounted to the tool plate are each arranged at an acute angle, especially preferably at an angle of 30° or 45°, to the vertical normal axis of the machine, whereby a particularly favorable transmission of forces to the floor can be achieved, which applies particularly at an arranged angle of 45°.

Particularly preferably, the tool plate and the second plate are each displaced on two parallel, linear guide bars, if the respective movements are to be effected as linear movements.

According to one embodiment of the invention, the tool plate and the second plate are advantageously mounted in the form of a 2D cross table.

Further, it is particularly recommendable if the drive for displacing the tool plate is also mounted on the second plate, which will cause the drive to be always taken along in the direction of movement of the second plate relative to the machine frame, and superposition of the second plate's movement onto that of the tool plate can be easily effected via the driving connection of the drive to the tool plate.

In a further advantageous embodiment of the invention, the tool plate and the second plate represent parts of a 3D cross table and, thus, are jointly movable also in a direction parallel to the direction of the wire, enabling a three-dimensional feed motion of all tools.

In a further preferred embodiment of the invention, the tool plate, with the tools mounted to it, is also rotatable about an axis perpendicular to the wire feed direction, such that the tools no longer contact the wire vertically in the operative position, which is desirable in some cases.

In certain cases of application, it may also be advantageous for tools mounted on the tool plate to be individually adjustable perpendicular to the plate. For this purpose, the respective tool holder can be provided with a corresponding adjusting device, allowing achievement of optimum alignment, if possible, with the wire guide, in individual cases.

In certain cases of application, it is also advantageous for tools on the tool plate to be provided with an additional rotary drive, for instance in a lathe tool comprising a lathe mandrel, which rotary drive will then allow performance of rotary movements also in the operative position.

Particularly preferably, in another embodiment of the invention, in each position of the tool plate and of the second plate relative to each other, a recess in the tool plate is arranged completely within the area defined by the recess of the second plate.

Advantageously, a sheet cover is arranged in the recess of the tool plate so as to extend circumferentially around the edge of the recess, which sheet cover covers the gap between the tool plate and the machine frame, so that no parts, fingers, or the like, can enter between the plates. This sheet cover is preferably screw-connected to the tool plate at four points, e.g. at four corners of the recess.

The two movable plates are arranged relative to each other and to the front plate of the machine frame such that the gaps between the tool plate and the second plate as well as between the second plate and the front wall of the machine frame each have a gap width ranging from 0.8 to 1.3 mm, and preferably 1 mm. This can be easily achieved by providing the two movable plates such that they are not "solid plates", but comprise recesses and pockets, each of the linear guides and the guide trolleys running on the plates being embedded in the assigned plate to such an extent that the desired narrow gap width is finally achieved.

The recess in the second plate preferably has a substantially rectangular shape, particularly preferably a square shape, which is favorable for reasons of symmetry and weight.

It is further particularly advantageous if a tool provided as a cutting knife is supported on the machine frame via a supporting arm, instead of on the tool plate, so that the considerable cutting forces are no longer transmitted to the machine frame via the tool plate, its support on the second plate and the support of the second plate, but are introduced directly into the machine frame. This measure, too, contributes to calm, low-vibration operation of the machine according to the invention and to reduced driving forces for both movable plates.

The wire-forming machine, according to one embodiment of the invention, leads to comparatively low costs and, at the same time, to a considerable cost reduction as compared to many disclosed machines. This improvement is achieved by simplification of the machine and the thus-possible reduction of the number of drive axes, without having to accept greater losses in performance.

BRIEF DESCRIPTION OF THE DRAWINGS

These as well as other objects and advantages of this invention, will be more completely understood and appreciated by referring to the following more detailed description of the presently preferred exemplary embodiments of the invention in conjunction with the accompanying drawings of which.

Figure 1:
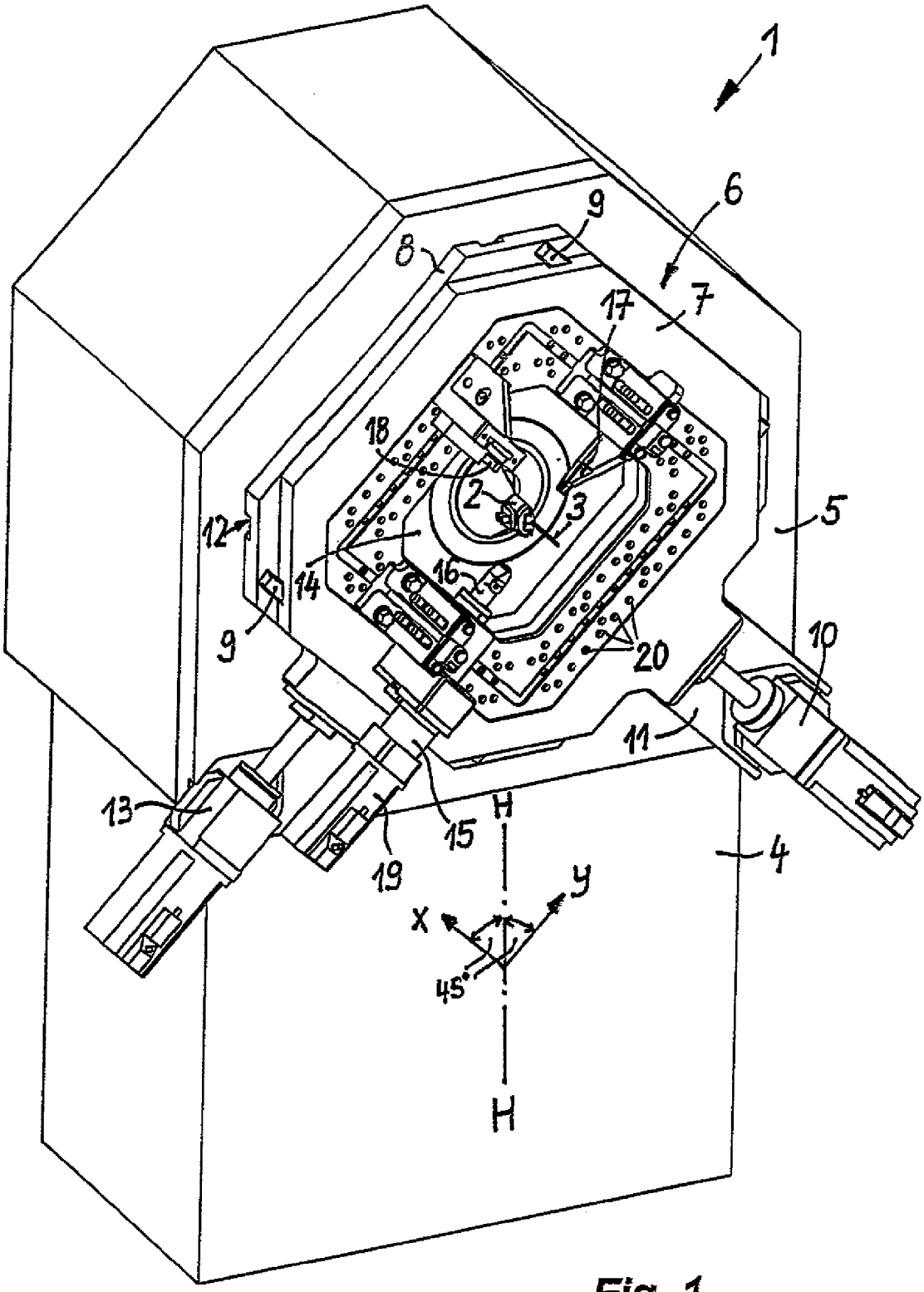
FIG. 1 shows a perspective front view of a wire-forming machine according to the invention in the form of a leg spring machine.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE INVENTION

Figure 2:
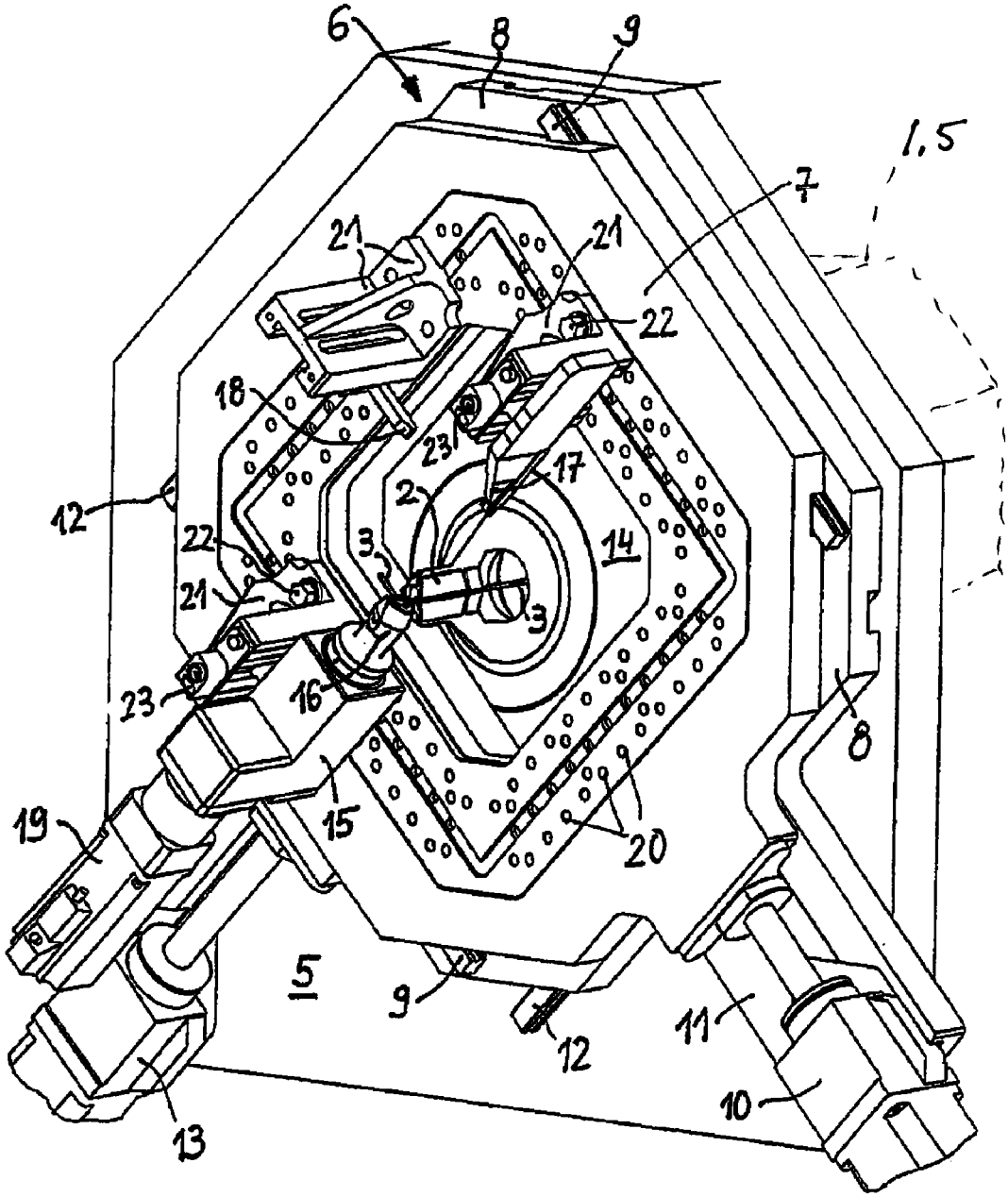
FIG. 2 shows an enlarged perspective view of the working area of the leg spring machine of FIG. 1, but in an oblique front view from top right in this case, in the operative position for bending.

Referring to FIG. 1, an oblique perspective view from the front (top left) of a wire-forming machine in the form of a leg spring machine 1, which comprises a wire feeder 1.5 shown schematically in FIG. 2, a straightening unit (not shown) as well as a wire guide 2, is shown. Both the wire feeder and the straightening unit as well as the wire guide 2 are rotatable about the longitudinal axis of the fed wire 3. These modules are known per se: the straightening unit consists of straightening rolls which are mounted in different planes and, by suitable feeding, respectively remove the internal stress within the wire 3 and thus, any bends, or produce a wire whose orientation is as straight as possible. The wire feeder consists of several driven pairs of rolls whose rotation causes the wire 3, clamped between them, to be conveyed through the wire guide 2 into the working area of the machine.

The leg spring machine 1 generally comprises a machine frame 4, which is shown only quite basically in FIG. 1 and whose front surface is provided with a front machine wall 5 (face wall).

A 2D cross table 6 is mounted to the front machine wall 5, said cross table being frontally provided with a tool plate 7 which is slidingly supported on a second plate 8 as a base plate. On the base plate 8, two parallel first linear guides 9 are mounted, along which the tool plate 7 is displaceable on the base plate 8 in a direction x, which is inclined at an angle of 45° to the vertical normal axis H-H of the leg spring machine 1 (obliquely, from bottom right to top left, in FIG. 1). In order to displace the tool plate 7 on the first linear guides 9 relative to the base plate 8, a spindle drive 10 is provided and is mounted to an extension arm 11 of the base plate 8 such that the spindle drive 10 is moved along thereon, while maintaining its position, upon each movement of the base plate 8.

The front machine wall 5 also has two parallel second linear guides 12 mounted to the front machine wall 5, on which the base plate 8 can be displaced relative to the front machine wall 5 (and, thus, to the machine frame 4), in a direction y, which is perpendicular to the direction of displacement x of the tool plate 7 and also extends at 45° to the vertical normal axis H-H of the leg spring machine (from bottom left to top right in FIG. 1).

A spindle drive 13, which may be mounted to the front machine wall 5, is provided for displacement of the base plate 8 on the linear guides 12.

Both the tool plate 7 and the second plate or base plate 8, respectively, are each centrally provided with a recess 14 extending around the wire guide 2, as shown in FIG. 1. The recesses 14 in both plates 7 and 8 have a square shape with obliquely cut-off corners and overlie each other in the initial inoperative position of the 2D cross table 6 and form a joint opening area through which the fed wire 3 can be conveyed into the working area of the machine 1 via the wire guide 2 without hindrance.

As is readily apparent from FIG. 1 (or from the other figures), several different tools are distributed around the recess 14 in the tool plate 7, such as a bending tool 15 including a rotatable bending head 16; a winding finger 17, on which several winding grooves can be provided; and finally a cutting tool 18. Of course, even more or fewer tools can be arranged around the recess 14 in the tool plate 7. Each of the tools is fixed to the tool plate 7 such that it is immobilized in the direction of a feed motion towards the wire guide 2.

If desired, each tool can be additionally provided with a drive. FIG. 1 indicates such a further drive 19 only for rotation of the bending head 16 of the bending tool 15. A grid 20 comprising a multiplicity of bores is arranged on the tool plate 7 in order to enable easy mounting of tools to be mounted thereto.

Figure 3:
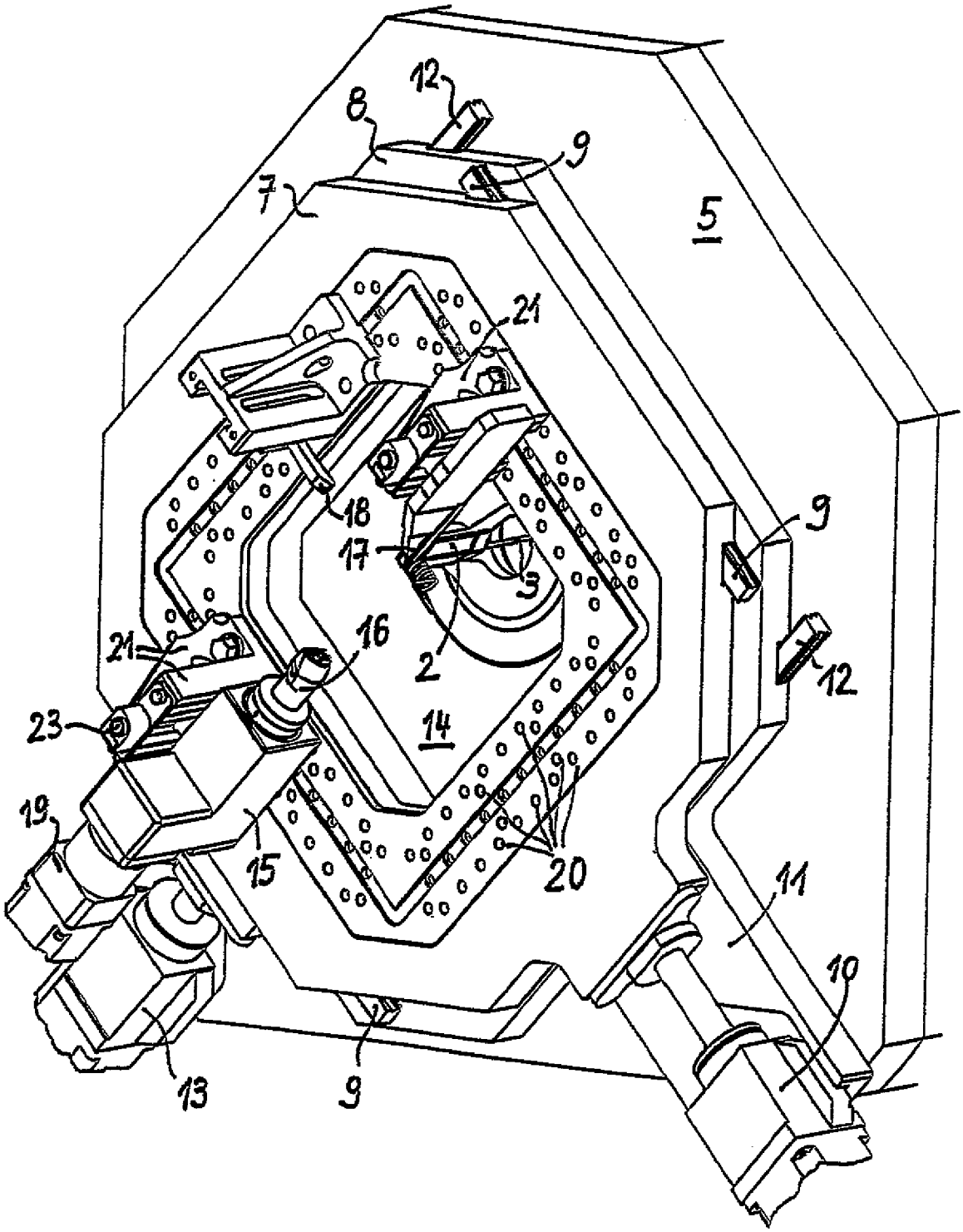
FIG. 3 shows an enlarged, oblique perspective view corresponding to FIG. 2, but in the operative position for winding.
Figure 4:
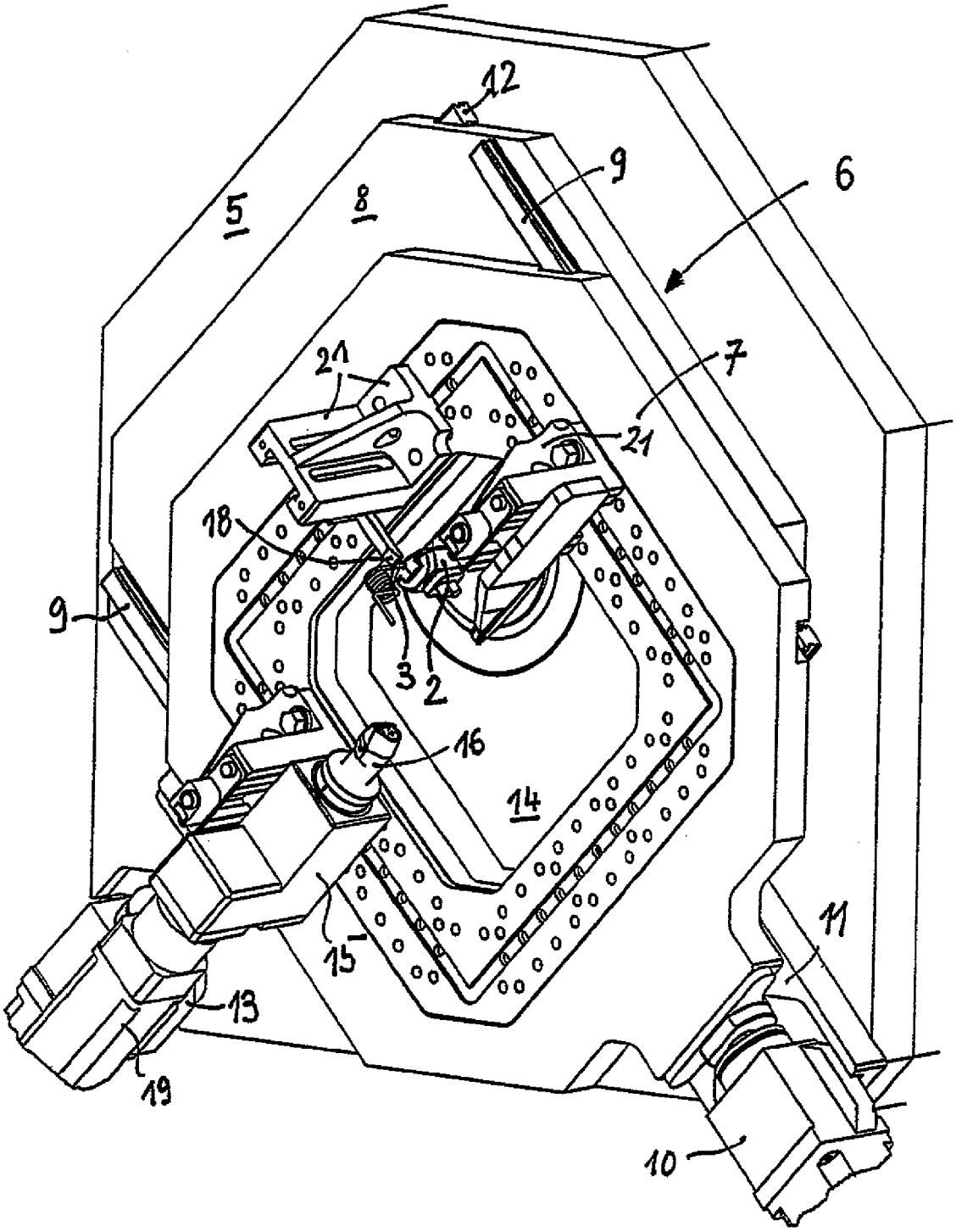
FIG. 4 shows an enlarged perspective view corresponding to FIGS. 2 and 3 of the machine of FIG. 1, but this time in the operative position shortly before the cut.

The enlarged frontal perspective view of FIGS. 2 to 4 makes the local conditions on the cross table 6 at different operative positions appear very clearly. First, as readily apparent from FIG. 2, for example, the tools used consist of tool holders 21, which are fitted into the bore grid 20 and can be screw-connected there by means of screws 22. The bore grid 20 extends around the entire periphery of the recess 14, allowing tools to be positioned in this grid as desired. The tool supports 21 can also be provided, for example, with an adjusting device 23 by which the position of the respective tool, in the longitudinal direction of the wire 3, can be adjusted to achieve an optimal alignment, if possible, with the wire guide 2.

The depicted embodiment of the leg spring machine 1 works as follows. The wire 3 is transported by the wire feeder (concealed in the Figures) from the back, through the wire guide 2, to the front, into the working area of the machine 1, where the wire 3 is sequentially processed and/or shaped, respectively, by the tools 15, 17 and 18. To position the wire guide 2 optimally with respect to the employed tools 15, 17 and 18, the wire guide 2 can be rotated around the longitudinal axis of the wire 3.

The respectively needed tool can be made to engage the wire 3 by actuating the drives 10 and 13 of the 2D cross table 6. FIG. 2 shows the condition in which the displacement of the tool plate 7 (whose displacement motion results, as a whole, from the superposition of its displacement relative to the base plate 8 and the displacement of the base plate 8 relative to the front machine wall 5) causes the bending head 16 of the bending tool 15 to approach the outlet of the wire guide 2 and to engage the wire 3. Then, either the drive 19 for the bending head 16 of the bending tool 15 (for a bending operation) or the wire feeder (for winding) is actuated.

In this manner, different ones of the mounted tools can be sequentially moved into the respectively assigned operative position by suitable displacement motions of the tool plate 7 of the 2D cross table 6 and, thus, a sequence of different processing operations can also be carried out on the wire 3 as desired. As the final operation, the cutting tool 18 approaches the wire 3 and is moved such that it shears off the wire 3 at the wire guide 2.

FIGS. 2 to 4 show different operative steps. In FIG. 2, the bending tool has approached the wire 3 and causes the continuously fed wire 3 to be bent into a corresponding shape.

FIG. 3 shows a position, in which the winding finger 17 has been moved to its operative position and the fed wire 3 is being wound.

Finally, FIG. 4 shows a position in which the cutting tool 18 has just approached the wire guide 2, and the displacement motion of the cutting tool 18 continues until the wire 3 is sheared off at the wire guide 2.

All of the tools 15, 17, 18 mounted to the tool plate 7 are jointly displaced by the two drives 10 and 13 of the 2D cross table 6 and do not require their own separate drives to move them into their operative positions. Should any further degrees of freedom be required, however, additional drives can be mounted to the tools, as well, without any problem.

For the manufacture of simple springs, wherein only winding and then separation is effected, for example, it is usually also sufficient to displace the tool plate 7 and/or the second plate 8 only along an axis of displacement of the cross table 6.

Instead of using a rotatable feeder, a rotary design of the entire tool unit is also contemplated for the leg spring machine 1 according to the invention. Further, instead of the 2D cross table 6, a 3D cross table can also be used to allow an additional motion of the tool plate 7 and, thus, of the tools mounted thereon, in the wire feed direction. Finally, the entire tool unit (2D cross table with tools mounted thereon) can be designed to be pivotable about an axis perpendicular to the wire 3, in which case the tools 15, 17, 18 would no longer engage the wire 3 perpendicularly. Even an inclination of the axes of displacement x, y at a little less or a little more than 45° to the vertical normal axis H-H of the machine 1, e.g. at 40° or at 50°, also still leads to relatively vibration-free operation of the entire machine.

Instead of mounting the cutting tool 18 to the tool plate 7, the cutting tool 18 can also be supported directly on the base frame 4 or its front plate 5 by means of a supporting arm (not shown in the Figures) in order to relieve the 2D cross table 6 from the introduction and absorption of the considerable cutting forces. However, in this case, the supporting arm itself must be displaceable relative to the machine frame, on the one hand, to effect its feed motion for cutting the wire 3. As an alternative, the supporting arm could also be immobile and the cutting tool 18, including its own feeding drive, could be carried by the supporting arm.

For set-up of the leg spring machine 1 according to one embodiment of the invention, it is recommendable to store the following process in the software of the machine control. In order to allow the user, if possible, to effect optimal setting of the leg spring machine 1, the user should input only the desired spring geometry via the input screen of the operating software. On the basis of this input, the software then computes the respective ideal tool positions, which are then output to the user for setting up the machine. After set-up of the machine, the positions have to be confirmed or modified by the user before the software generates the actual manufacturing program. It is also possible to provide an automatic inquiry into the tool positions. Control of the manufacturing process is then ultimately effected on the basis of the defined program, via a central process control device.

Although specific examples have been illustrated and described herein, it will be appreciated by those of ordinary skill in the art that any arrangement calculated to achieve the same purpose could be substituted for the specific examples shown. This application is intended to cove adaptations or variations of the present subject matter. Therefore, it is intended that the invention be defined by the attached claims and their legal equivalents.

I claim:

1. A wire-forming machine comprising:

a machine frame, a base plate movably mounted on a front side of the machine frame, the base plate being linearly movable in an x direction with respect to the machine frame, the base frame having a central recess;

a drive for linearly moving the base plate with respect to the machine frame;

a tool plate being mounted on and overlaying the base plate and being linearly movable with respect to the base plate in a y direction, the y direction being 90 degrees from the x direction, the tool plate having a central recess thereon, the tool plate surrounding the central recess, the tool plate adapted for mounting tools thereon;

a drive for linearly moving the tool plate;

a wire feeder feeding wire to a wire guide along a forwardly extending longitudinal wire axis, the wire guide positioned within the central recess of the base plate and within the central recess of the tool plate, the wire guide for guiding wire to a working area of the machine;

wherein each tool mounted on the tool plate is linearly movable from an initial position remote from the wire to an operative position at the working area of the machine for processing the wire guided by the wire guide, each tool on the tool plate is movable to the operative position by way of linearly moving at least one of the base plate and tool plate.

2. The wire-forming machine of claim 1, wherein the base plate is mounted to the machine frame such that the x direction is at an angle of 45° from vertical and the tool plate is mounted to the machine frame such that the y direction is at an angle of 45° from vertical, and the longitudinal axes of the tools mounted to the tool plate are arranged at an angle of 45° to vertical.

3. The wire-forming machine of claim 2, wherein the tool plate and the base plate are each displaceably guided on two parallel linear guiding bars.

4. The wire-forming machine of claim 3, wherein the tool plate and the base plate form a 2D cross table.

5. The wire-forming machine of claim 4, wherein a drive for displacing the tool plate is mounted to the base plate.

6. The wire-forming machine of claim 5, wherein tools mounted to the tool plate are adjustable perpendicular to the tool plate.

7. The wire-forming machine of claim 6, wherein tools mounted on the tool plate are provided with an additional rotary drive.

8. The wire-forming machine of claim 1, wherein in any position of the tool plate and the base plate relative to each other, the recess of the tool plate is located completely within the area defined by the recess of the base plate.

9. The wire-forming machine of claim 1, wherein gaps between the tool plate and the base plate, and gaps between the second base plate and the machine frame respectively range from 0.8 to 1.3 mm in width.

10. The wire-forming machine of claim 9, wherein the recess in the base plate has a substantially square shape.

11. The wire-forming machine of claim 10, further comprising a tool, wherein the tool is a cutting knife and is supported on the machine frame via a supporting arm.

12. The wire-forming machine of claim 1 wherein the wire-forming machine is a spring-bending machine.

13. The wire-forming machine of claim 1 wherein the wire-forming machine is a spring-winding machine.

14. A wire-forming machine comprising a machine frame, a base plate movably affixed to the machine frame at a front of the machine, the base plate movable linearly with respect to the machine frame, a tool plate movably affixed to the base plate and overlaying the base plate and linearly movable with respect to the base plate, wherein the tool plate has a first recess through which wire may be fed to a working area of the machine, the first recess closed on four sides a wire guide positioned within the recess, and at least one tool mounted on the tool plate, wherein the wire guide guides fed wire to the working area of the machine where the wire may be processed by the at least one tool, wherein the at least one tool is arranged on the tool plate around the first recess and are fixedly attached to the tool plate; and wherein the tool plate is displaceable along a first direction (x) on the base plate and the base plate is displaceable on the machine frame along a second base direction (y) perpendicular to the first direction (x) from a frontal view of the machine, wherein both directions (x, y) respectively have an inclination of 45° each from vertical.

15. The wire-forming machine of claim 14 wherein each tool is movable via a feed motion from an initial position remote from the wire to an operative position at the wire.

16. The wire-forming machine of claim 15 wherein each tool is fixedly attached to the tool plate in the direction of each respective tool's feed motion relative to the tool plate, and the feed motion to each tool's operative position is produced by a corresponding motion of the tool plate.

17. The wire-forming machine of claim 15 wherein longitudinal axes of the tools mounted to the tool plate are arranged at an angle of 45° to vertical.

18. A wire-forming machine comprising a machine frame with a front, a base plate linearly and movably attached with respect to the machine frame at the front of the machine, a tool plate linearly and movably attached to the base plate and overlaying the base plate wherein the tool plate comprises a first recess through which wire may be fed to a working area of the machine, the recess having substantially a square shape, a wire guide positioned in the recess for guiding wire to a working area, and a pair of tools mounted on the tool plate, wherein the pair of tools are arranged on the tool plate around the first recess and are fixedly attached to the tool plate; and wherein the tool plate is displaceable along a first direction (x) on the base plate and the base plate displaceable on the machine frame along a second base direction (y) perpendicular to the first direction (x) from a frontal view of the machine.

* * * * *